US009885182B1

(12) United States Patent
Harkins

(10) Patent No.: US 9,885,182 B1
(45) Date of Patent: Feb. 6, 2018

(54) METHOD OF PULLING A SHEET OF FLEXIBLE MATERIAL

(71) Applicant: Daniel J. Harkins, Port Charlotte, FL (US)

(72) Inventor: Daniel J. Harkins, Port Charlotte, FL (US)

( * ) Notice: Subject to any disclaimer, the term of this patent is extended or adjusted under 35 U.S.C. 154(b) by 0 days.

(21) Appl. No.: 15/249,528

(22) Filed: Aug. 29, 2016

(51) Int. Cl.
*E04D 5/14* (2006.01)

(52) U.S. Cl.
CPC ..... *E04D 5/142* (2013.01); *E04D 5/146* (2013.01); *E04D 5/148* (2013.01)

(58) Field of Classification Search
CPC . E04D 5/142; E04D 5/146; E06B 9/58; E06B 9/42
USPC ..... 52/22, 63, 749.12, 125.2; 135/115, 119, 135/120.3; 160/265, 368.2
See application file for complete search history.

(56) References Cited

U.S. PATENT DOCUMENTS 1,106,624 A * 8/1914 Cadwallader et al. . E04F 10/02 135/903
4,259,819 A 4/1981 Wemyss
4,296,568 A * 10/1981 Dukes ..... A01G 13/0206 47/17
4,353,188 A * 10/1982 Seago ..... E04H 5/02 52/22
4,387,533 A * 6/1983 Green ..... A01G 9/22 47/17
5,197,238 A * 3/1993 Peleg ..... A01G 9/1407 47/17
5,197,239 A * 3/1993 Glynn ..... E04G 5/12 160/84.01
5,311,699 A * 5/1994 Huffman ..... A01G 9/22 47/22.1
5,520,236 A * 5/1996 Thomas ..... A01G 9/227 160/120
5,839,237 A * 11/1998 Davidson ..... E06L 33/7001 150/154
6,092,581 A * 7/2000 Andersson ..... E06B 9/40 160/266
6,152,207 A * 11/2000 Varley ..... E06B 9/13 160/264
6,283,191 B1 * 9/2001 Lo ..... E06B 9/262 160/265
8,777,516 B2 * 7/2014 Slutz ..... B09B 1/004 160/120
2009/0156086 A1 * 6/2009 Hartings ..... A63H 23/005 446/124

* cited by examiner

*Primary Examiner* — Paola Agudelo
(74) *Attorney, Agent, or Firm* — Donald J. Ersler

(57) ABSTRACT

A method of pulling a sheet of flexible material includes forming a row of a plurality of lengthwise slits in a sheet of material; providing at least one pull device; and providing at least one cable winch. A tubular pull rod is inserted through the plurality of slits. A pull device preferably includes a first pull strap, a second pull strap, a spreader bar and a strap ring. First and second pull devices are positioned near opposing sides of the sheet of material. First and second winches are secured to the floor on one sidewall of the building. The sheet of material is laid on the floor at an opposing sidewall of the building. Cables from the first and second winches are pulled over struts in the building and secured to the first and second pull devices. The sheet of flexible material is pulled to the one sidewall.

21 Claims, 14 Drawing Sheets

METHOD OF PULLING A SHEET OF FLEXIBLE MATERIAL

BACKGROUND OF THE INVENTION

1. Field of the Invention

The present invention relates generally to buildings and more specifically to a method of pulling a sheet of flexible material, which is quicker and more economical than that of the prior art.

2. Discussion of the Prior Art

It appears that the prior art does not teach or suggest a method of pulling a sheet of flexible material. U.S. Pat. No. 1,106,624 to Cadwallader et al. discloses a protective covering for orchards. U.S. Pat. No. 4,259,819 to Wemyss discloses a method and apparatus for anchoring sheet material to a framework.

Accordingly, there is a clearly felt need in the art for a method of pulling a sheet of flexible material, which is quicker and more economical than that of the prior art.

SUMMARY OF THE INVENTION

The present invention provides a method of pulling a sheet of flexible material, which is quicker and more economical than that of the prior art. The method of pulling a sheet of flexible material includes forming a row of a plurality of lengthwise slits, near an end of a sheet of material; providing at least one pull device; and providing at least one cable winch. Each slit is substantially parallel to a length of the sheet of material and the row of the plurality of lengthwise slits are substantially perpendicular to a length of the sheet of material. The slits are long enough to allow insertion of a cross section of a tubular pull rod through at least substantially all of a width of the sheet of material. A pull device preferably includes a first pull strap, a second pull strap, a spreader bar and a strap ring. However, other designs of pull devices may also be used. One end of the first and second pull straps is secured to the strap ring. Preferably, a threaded fastener is retained near the other end of the first and second straps. A fastener hole is formed in the other end of the first and second straps. A fastener hole is formed through each end of the spreader bar. The threaded fasteners of the first and second pull straps are inserted through the fastener holes in each end of the spreader bar. The first and second straps are wrapped around the tubular pull rod. The threaded fastener in the first and second straps are inserted through the fastener hole in the other end of the first and second straps. A wing nut or the like is threaded on to the threaded fastener to retain the spreader bar and the other end of the first or second strap. A first pull device is used near a first side of the sheet of material and a second pull device is used near a second side of the sheet of material.

The at least one winch is secured to the floor on one side of the building. The sheet of material is laid on the floor at an opposing side of the building. The at least one pull device is secured to the tubular pull rod. An end of the cable from the at least one winch is pulled over an inside corner strut on the one side of the building; over a plurality of support struts; and over an inside corner strut on the opposing side of the building. An end of the cable is secured to the strap loop of the pull device. The at least one winch is rotated to pull the sheet of material over the two inside corner struts and the plurality of support struts. Once the sheet of flexible material is fully pulled over the plurality of struts, preferably a sticky tape is applied to an area of the sheet of flexible material on top of each corner strut. A metal right angle is applied to a top of the sticky tape and the metal right angle is secured to the corner strut with a plurality of self-drilling fasteners.

Accordingly, it is an object of the present invention to provide a method of pulling a sheet of flexible material, which is quicker and more economical than that of the prior art.

These and additional objects, advantages, features and benefits of the present invention will become apparent from the following specification.

DETAILED DESCRIPTION OF THE PREFERRED EMBODIMENTS

Figure 1:
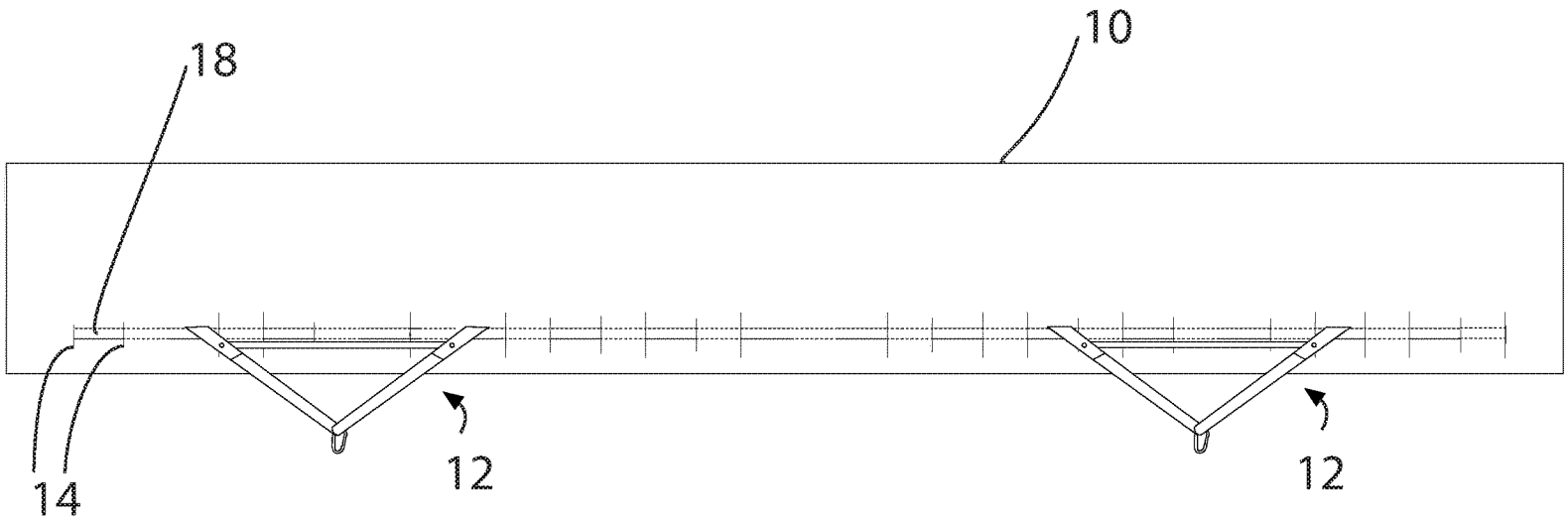
FIG. 1 is a top view of a sheet of flexible material with two pull devices engaged therewith of a method of pulling a sheet of flexible material in accordance with the present invention.
Figure 2:
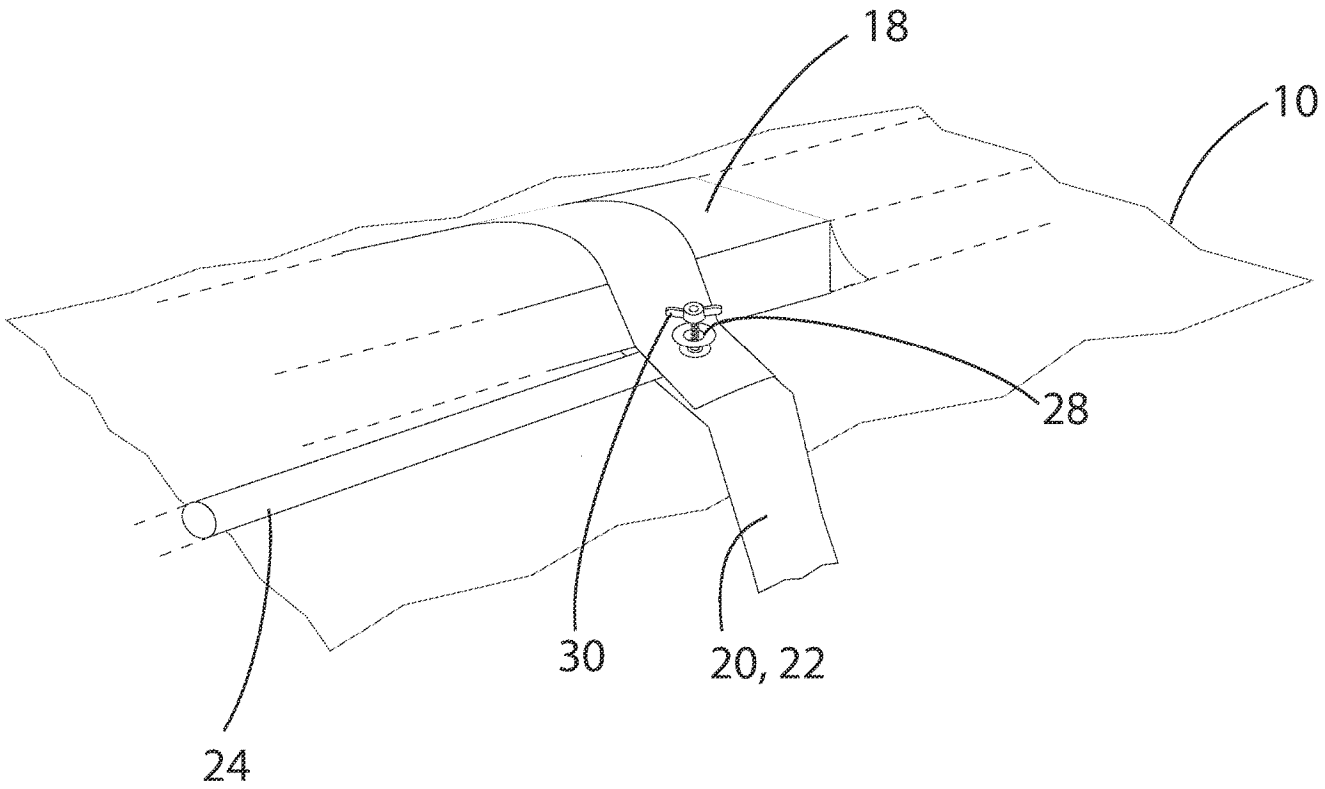
FIG. 2 is an enlarged perspective view of a tubular pull rod inserted through slits in a flexible material and a pull strap secured to the tubular pull rod of a method of pulling a sheet of flexible material in accordance with the present invention.
Figure 3:
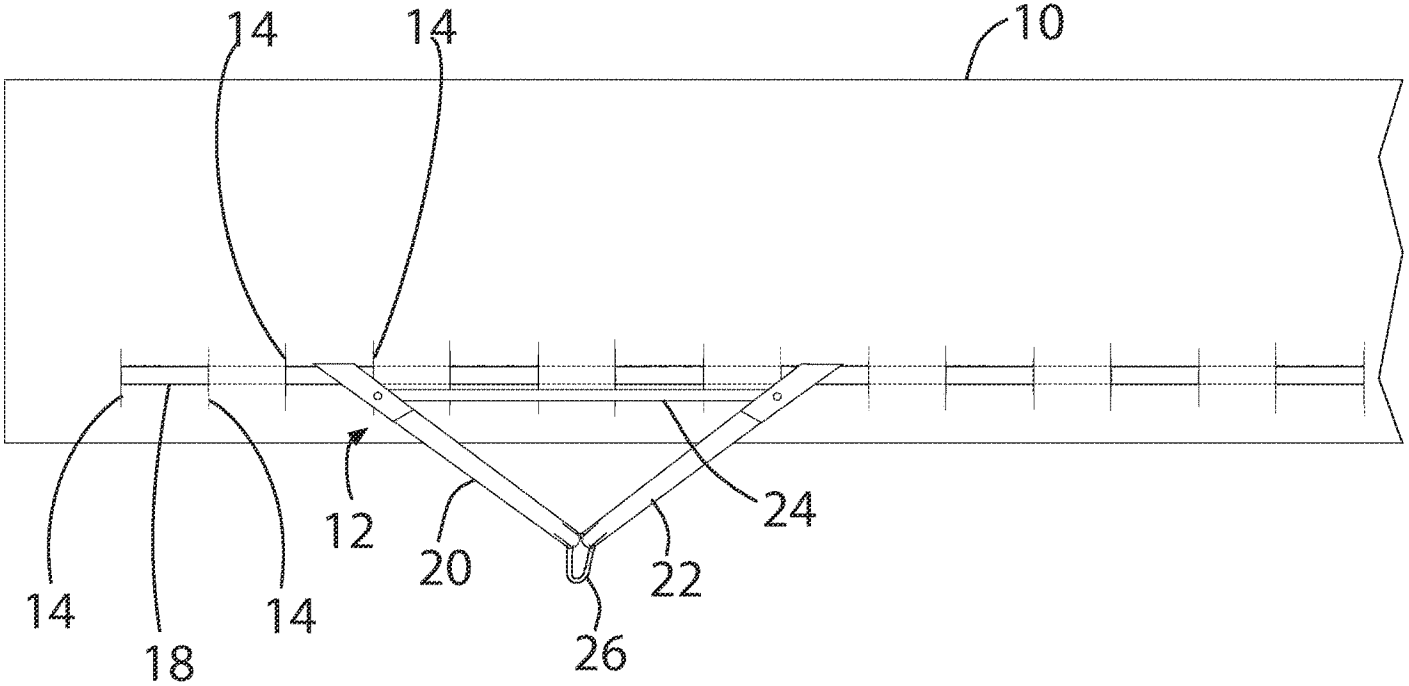
FIG. 3 is an enlarged top view of a sheet of flexible material with a pull device engaged therewith of a method of pulling a sheet of flexible material in accordance with the present invention.
Figure 5:
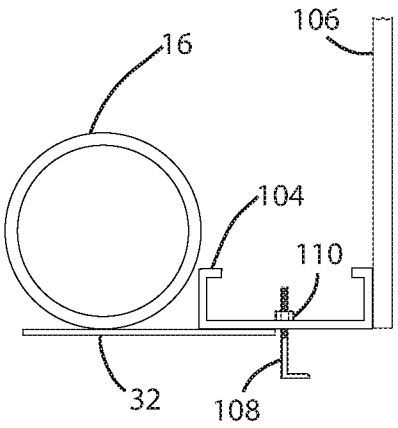
FIG. 5 is an end view of a base plate of a winch retained under a base channel of a method of pulling a sheet of flexible material in accordance with the present invention.
Figure 4:
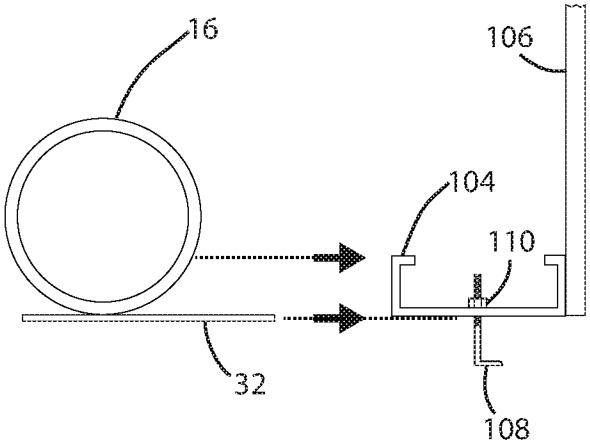
FIG. 4 is an end view of a winch before thereof is inserted under a base channel of a method of pulling a sheet of flexible material in accordance with the present invention.

With reference now to the drawings, and particularly to FIG. 1, there is shown a top view of a sheet of flexible material 10 with two pull devices 12 engaged therewith of a method of pulling a sheet of flexible material. With reference to FIGS. 2-6, the method of pulling a sheet of flexible material preferably includes forming a row of a plurality of lengthwise slits 14, near an end of the sheet of flexible material 10; providing the at least one pull device 12; and providing at least one cable winch 16. Each slit 14 is substantially parallel to a length of the sheet of material 10 and the row of the plurality of lengthwise slits 14 are substantially perpendicular to a length of the sheet of material 10. Each slit is long enough to allow insertion of a cross section of a tubular pull rod 18 through substantially a width of the sheet of material 10. The pull device 12 preferably includes a first pull strap 20, a second pull strap 22, a spreader bar 24 and a strap ring 26. One end of the first and second pull straps 20, 22 are secured to the strap ring 26. However, the first pull strap, the second pull strap 22 and the strap ring 26 could be replaced with a single strap or cable, or may be eliminated if the pull cable 34 is coupled directly to the pull rod 18, but with the results of less control and strength.

Preferably, a threaded fastener 28 is retained near the other end of the first and second straps 20, 22. A fastener holes (not shown) are formed in the other ends of the first and second straps 20, 22 to receive the threaded fastener 28. A fastener hole (not shown) is formed through each end of the spreader bar 24 to receive the two threaded fasteners 28. The two threaded fasteners 28 are inserted in two holes (not shown) formed through distal ends of the first and second pull straps 20, 22 and are inserted through the fastener holes in each end of the spreader bar 24. The one end of the first and second straps are wrapped around the tubular pull rod 18. The threaded fastener 28 in the first and second straps 20, 22 and through the spreader bar are inserted through the fastener holes in the distal end of the first and second straps 20, 22. A wing nut 30 or the like is threaded on to the threaded fastener 28 to secure the spreader bar 24 to the other end of the first or second strap 20, 22. It is possible to pull the sheet of flexible material 10 with only one pull device 12. However, two spaced apart pull devices 12 allow for directional control, left or right of the sheet of flexible material 10. Preferably, the first pull device 12 is used near a first side of the sheet of flexible material 10 and the second pull device 12 is used near a second side of the sheet of material 10.

Figure 6:
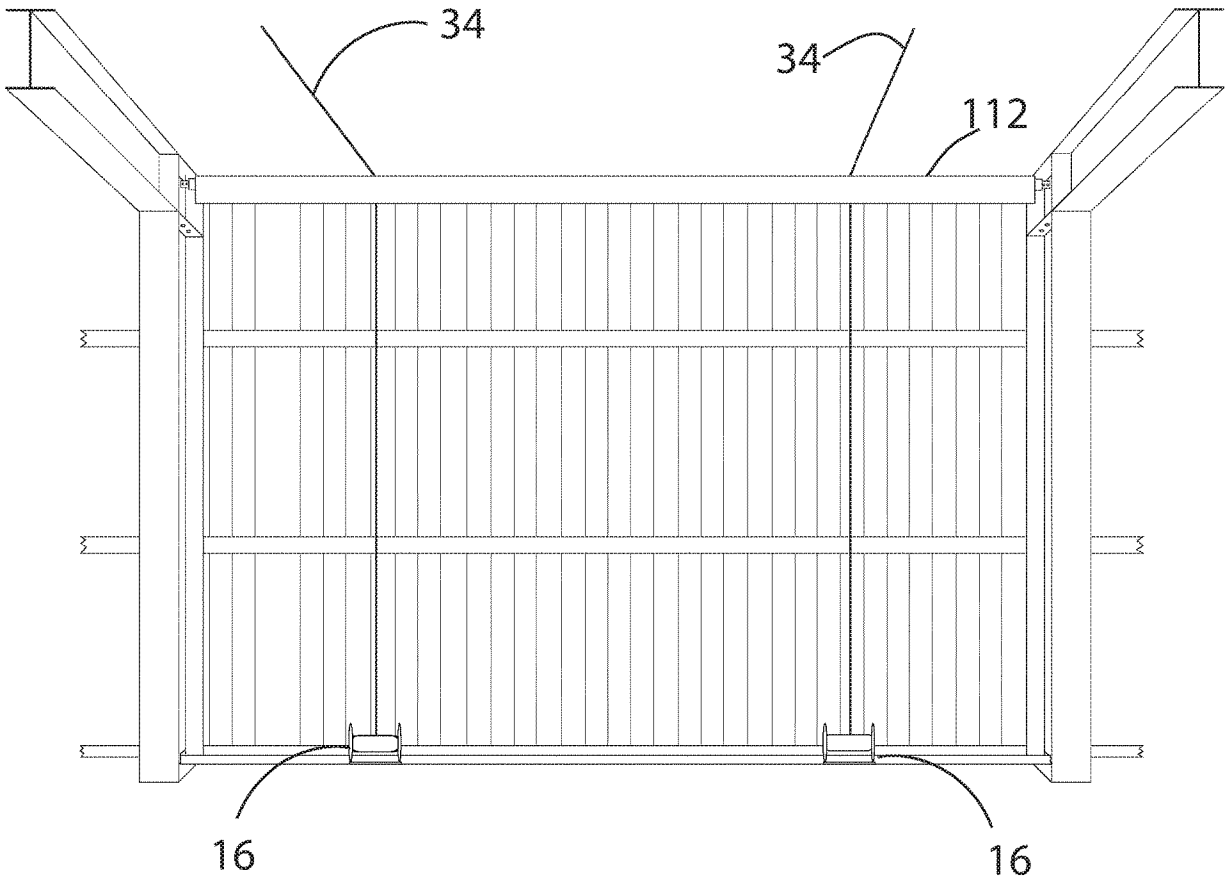
FIG. 6 is a front view of one side of the building with two winches retained on a floor of a method of pulling a sheet of flexible material in accordance with the present invention.
Figure 7:
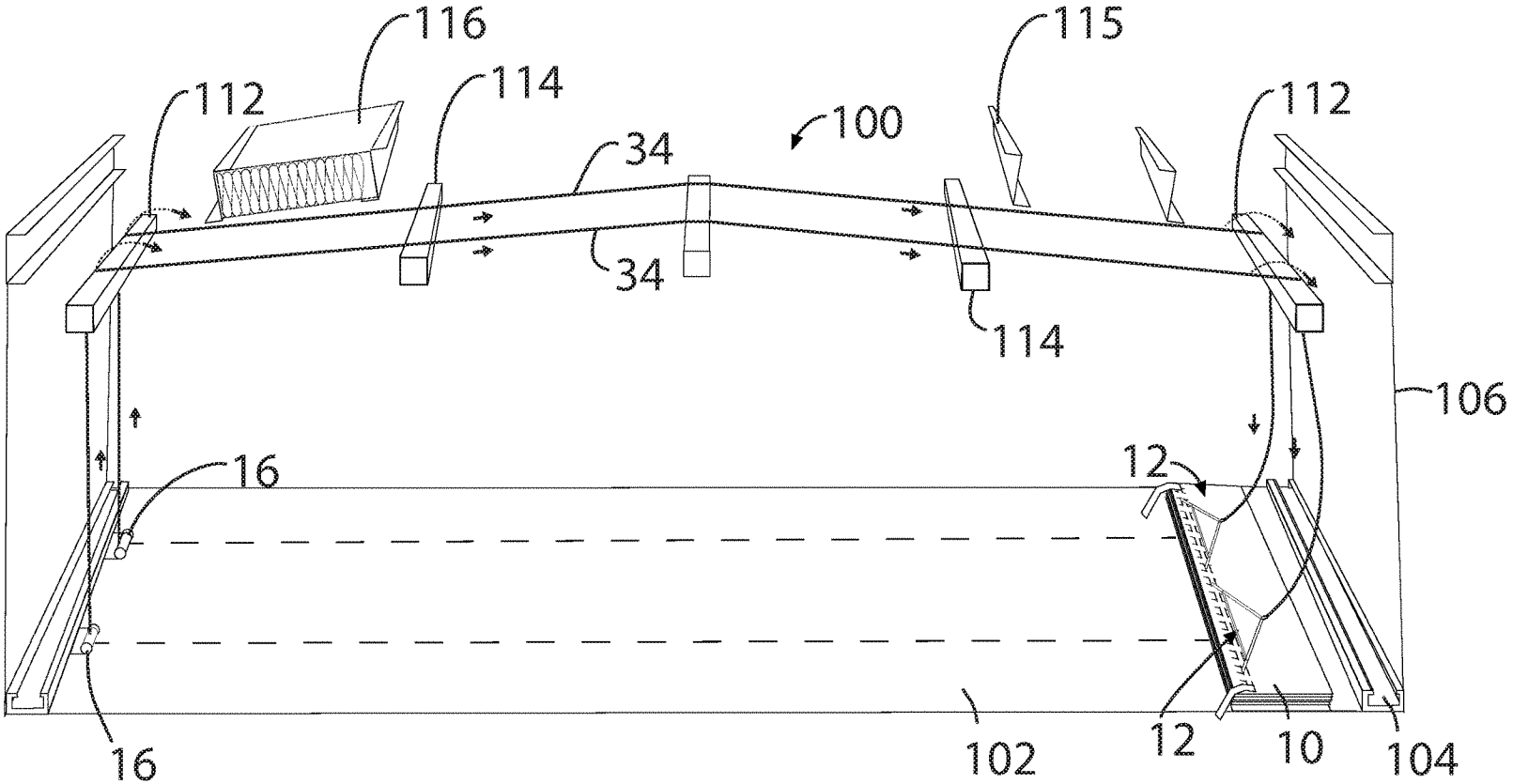
FIG. 7 is a perspective side view of a method of pulling a sheet of flexible material with two winches located adjacent one side wall; two cables extending from the two winches over a plurality of struts; and coupled to a sheet of flexible material in accordance with the present invention.
Figure 8:
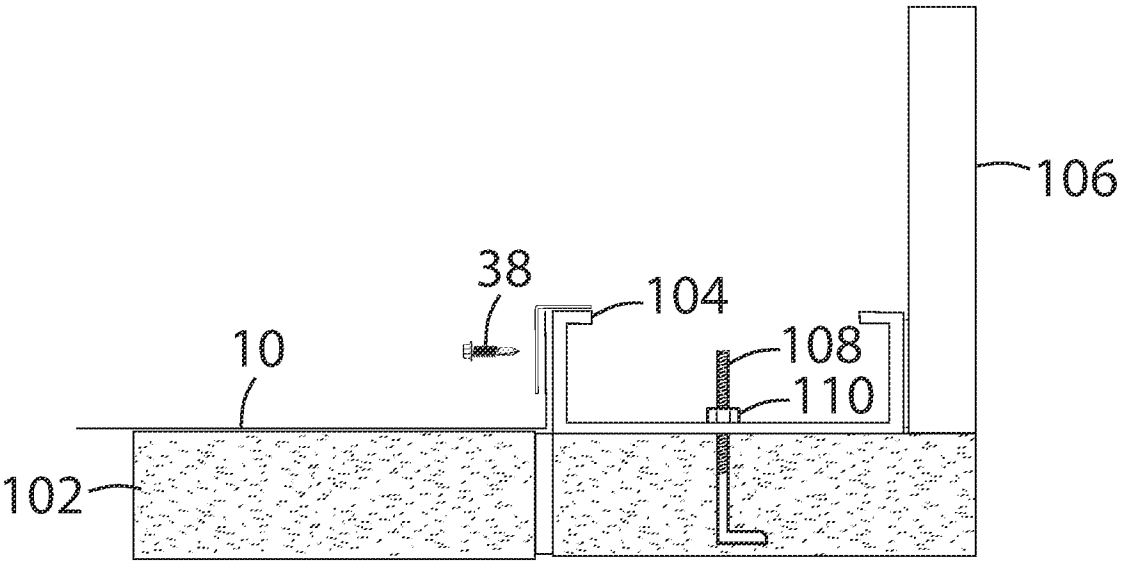
FIG. 8 is an end view of one end of a sheet of flexible material before temporarily attachment to a base channel of a method of pulling a sheet of flexible material in accordance with the present invention.

With reference to FIGS. 6-8, a base channel 104 is secured to a floor 102 of a building 100, adjacent a wall 106 with a plurality of lag bolts 108 or the like. Each winch 16 includes a base plate 32 and a cable 34. A nut 110 of the lag bolt 108 is loosened to allow the base channel 104 to be lifted to allow insertion of the base plate 32 of the winch 16, under the base channel 104. The nut 110 is tightened to secure the winch 16. The two winches 16 are preferably positioned, such that a middle of each winch 16 is located approximately one-fifth of a width of the sheet of flexible material 10 from an edge of the sheet of flexible material 10. The sheet of flexible material 10 is laid on the floor 102 at an opposing side of the building 100 from the two cable winches 16. The at least one pull device 12 is secured to the tubular pull rod 18. The other end of the flexible sheet of material 10 is temporarily secured to the base channel 104 with a metal angle 36 and a plurality of self-drilling screws 38. The two cables 34 are pulled over an inside corner strut 112 on a winch side of the building 100; over a plurality of support struts 114; and over an inside corner strut 112 on the opposing side of the building 100. An end of the cable 34 is secured to the strap ring loop 26 of the pull device 12.

Figure 9A:
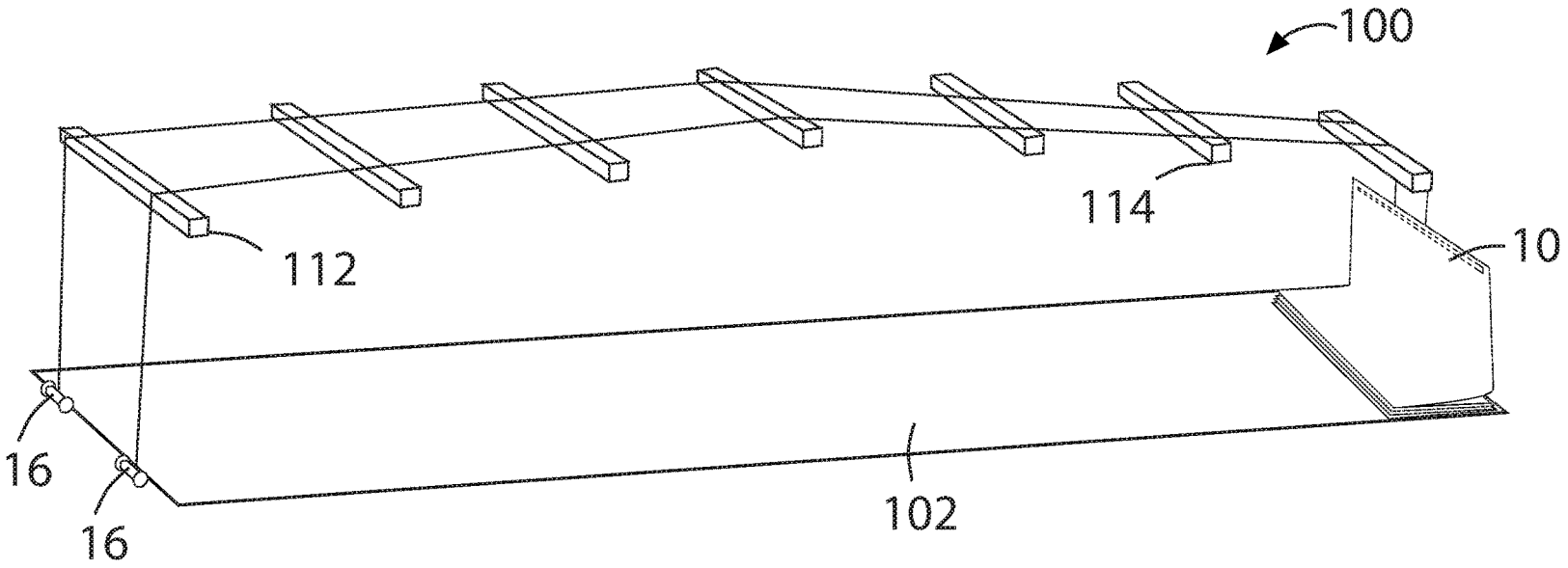
FIG. 9*a* is a perspective side view of a method of pulling a sheet of flexible material with two winches located adjacent one side wall; two cables extending from the two winches; coupled to a sheet of flexible material; and the sheet of flexible material partially pulled up a side wall in accordance with the present invention.
Figure 9B:
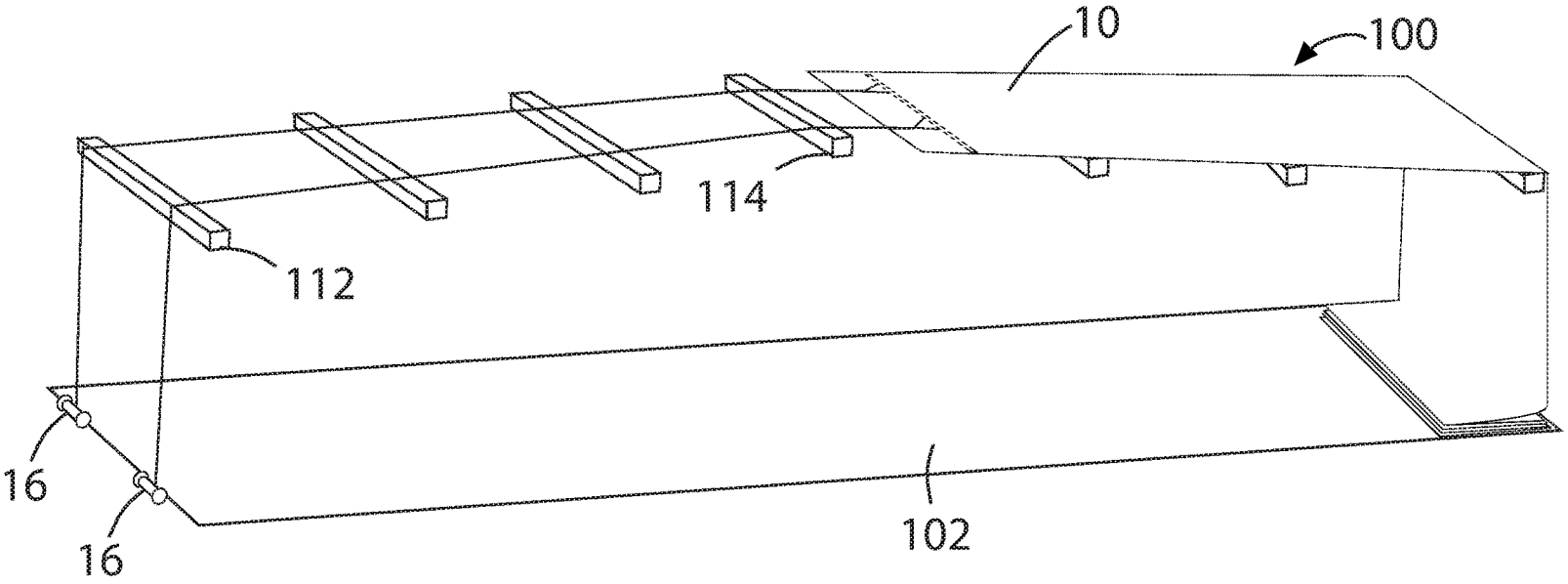
FIG. 9*b* is a perspective view of a method of pulling a sheet of flexible material with two winches located adjacent one side wall; two cables extending from the two winches; coupled to a sheet of flexible material; and an end of the sheet of flexible material located adjacent a middle of a roof in accordance with the present invention.
Figure 9C:
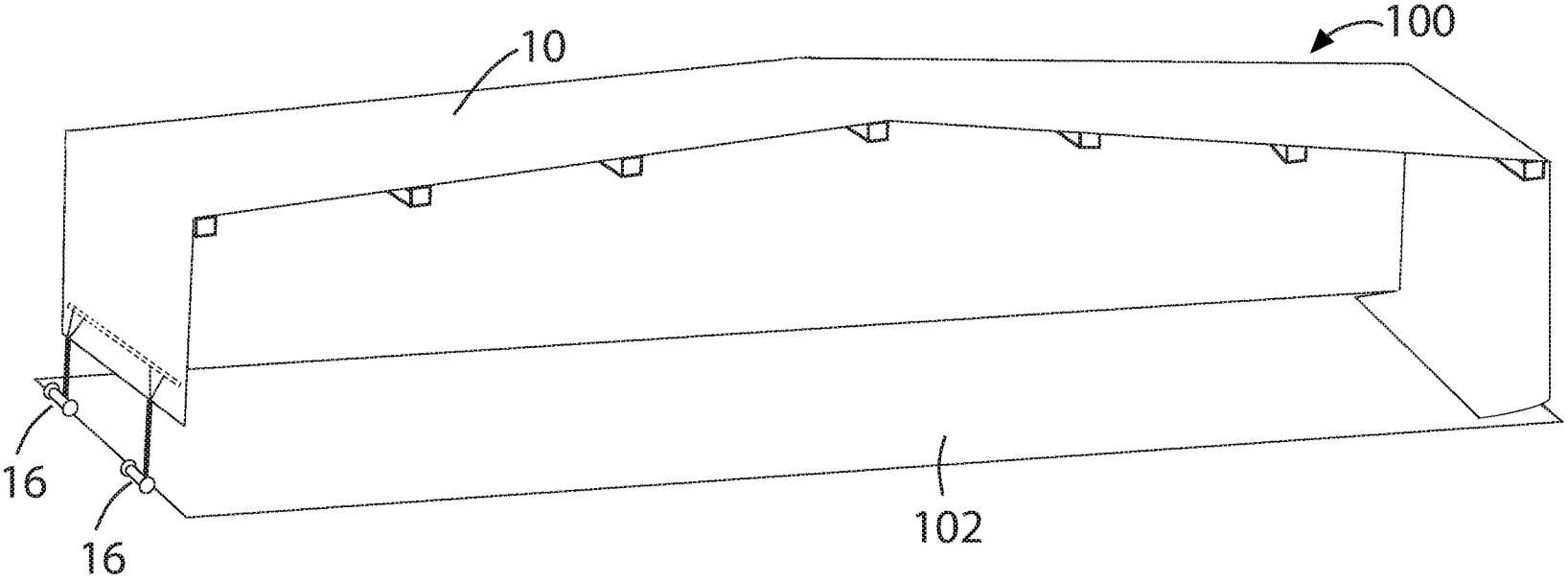
FIG. 9*c* is a perspective view of a method of pulling a sheet of flexible material with two winches located adjacent one side wall; two cables extending from the two winches; coupled to a sheet of flexible material; and the sheet of flexible material pulled adjacent a bottom of a wall on one side of the building in accordance with the present invention.
Figure 10:
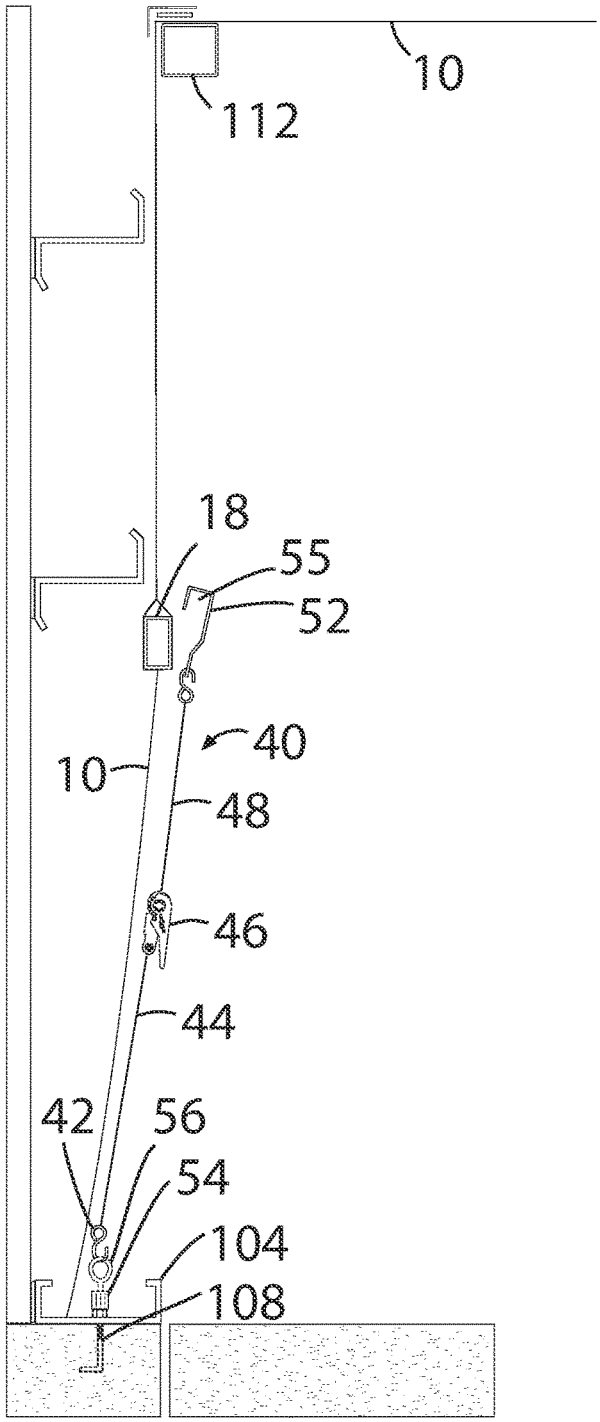
FIG. 10 is a side view of a tensioning device with one end secured to a lag bolt and the other end adjacent a tubular pull rod of a method of pulling a sheet of flexible material in accordance with the present invention.
Figure 11:
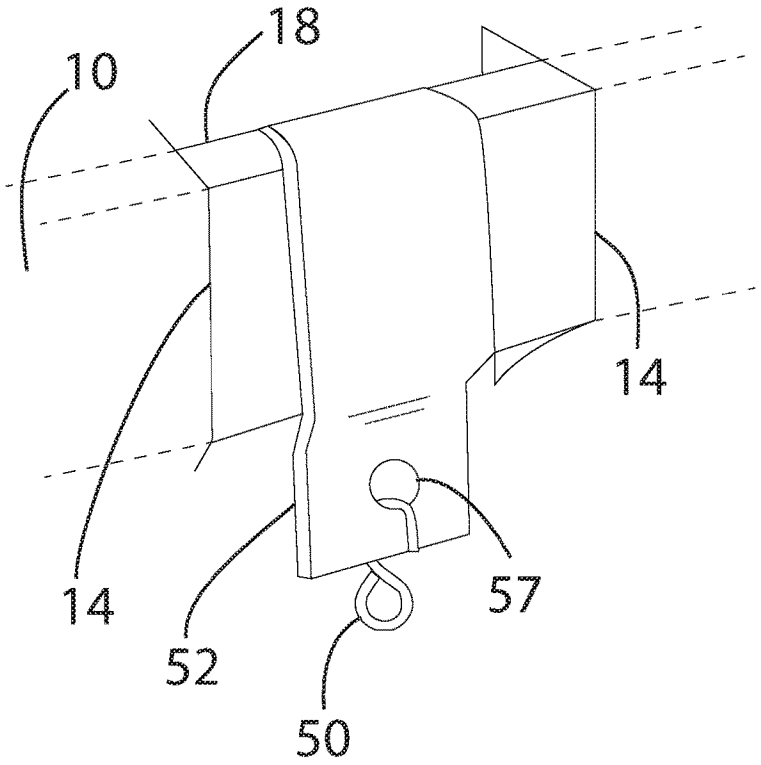
FIG. 11 is a perspective view of a rod hook of a tensioning device secured to a tubular pull rod of a method of pulling a sheet of flexible material in accordance with the present invention.

With reference to FIGS. **9*a*-9*c*, the two winches 16 are rotated to pull the sheet of flexible material 10 over the two inside corner struts 112 and the plurality of support struts 114. The pull device 12 is secured to the tubular pull rod 18 and pulled with the cable 34 by rotating the two winches 16. The two winches 16 may be used to pull the sheet of flexible material 10 taut, but for more uniform tension it is preferred to use multiple tensioning devices 40. With reference to FIG. 9*c*, once the end of the sheet of flexible material 10 is pulled near the floor 102, at least one tensioning device 40 is used to pull the sheet of flexible material 10 taut. With reference to FIGS. 10-11, the tensioning device 40 includes a first end hook 42, a first line 44, a ratchet device 46, a second line 48, a second end hook 50 and a pull rod hook 52. A threaded coupler 54 is threaded on to the lag bolt 108. An eye bolt 56 is threaded into the threaded coupler 54. One end of the first line 44 is secured to the first end hook 42 and the other end of the first line 44 is secured to one end of the ratchet device 46. One end of the second line 48 is secured to the other end of the ratchet device 46 and preferably the other end of the second line 48 is secured to the second end hook 50. The pull rod hook 52 includes an inner width 55, which is sized to receive a thickness of the tubular pull rod 18. The second end hook 50 is inserted into a hook hole 57 in a bottom of the pull rod hook 52. At least one tensioning device 40 is used to pull the sheet of flexible material 10 taut. The first end hook 42 is preferably retained in the eye bolt 56, but the first line 44 could also be secured to the base channel 104. The ratchet device 46 of the tensioning device 40 is operated to tension the sheet of flexible material 10** taut.

Figure 12:
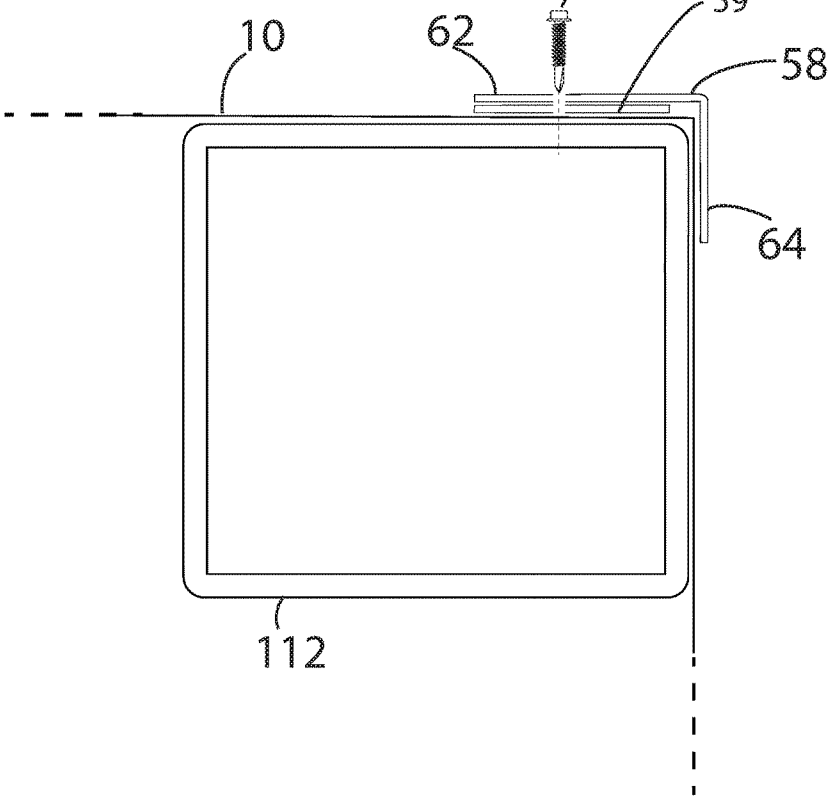
FIG. 12 is an end view of a sheet of flexible material secured to a inside corner strut with a sticky tape, a metal right angle and a plurality of self-drilling screws of a method of pulling a sheet of flexible material in accordance with the present invention.

With reference to FIG. 12, the sheet of tensioned flexible material 10 is secured to the two inside corner struts 112 with a metal angle 58, sticky tape 59 and a plurality of self-drilling fasteners 60. The sticky tape 59 is a double sided tape. The sticky tape 59 is applied to a horizontal surface of the sheet of flexible material 10, adjacent a corner of the inside corner strut 112 or to a surface of the metal angle 58. The metal angle 58 includes a first leg 62 and a second leg 64. The first leg 62 is preferably longer than the second leg 64. The second leg serves to stiffen the metal angle 58 to attain a generally uniform pressure attachment to the sheet of flexible material 10 along the length of the secured metal angle 58, however other shapes may be used. An inside surface of the first leg 62 is applied to the sticky tape 59, while forcing the second leg 64 against a vertical portion of the inside corner strut 112.

Figure 13:
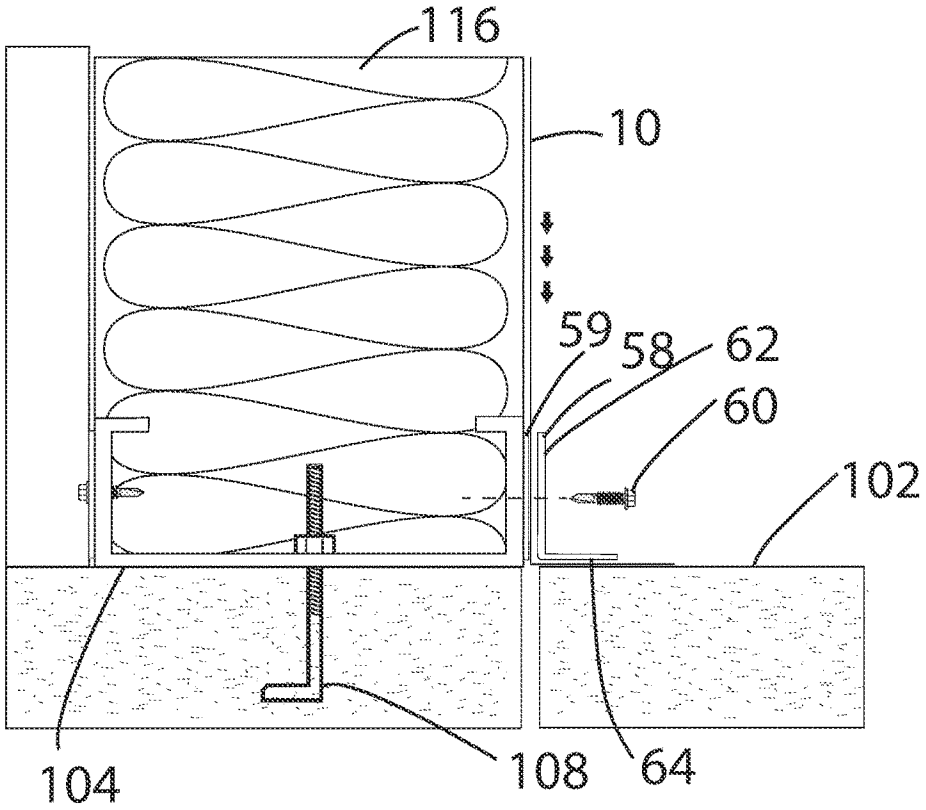
FIG. 13 is an end view of an end a sheet of flexible material before permanent attachment to a base channel with sticky tape, a metal angle and a plurality of self-drilling screws of a method of pulling a sheet of flexible material in accordance with the present invention.

With reference to FIGS. 7 and 9*c*, any suitable insulation 116 may be installed adjacent a plurality of purlins 115 and adjacent to a surface of the taut sheet of flexible material 10 of FIG. 9*c*. With reference to FIG. 13, the insulation 116 may be installed adjacent to a vertical surface of the taut sheet of flexible material 10. With reference to FIG. 13, each end of the sheet of flexible material 10 is secured to one of the base channels 104 with the metal angle 58, the sticky tape 59 and the plurality of self-taping fasteners 60. The sticky tape 59 is applied on one of an inside surface of the base channel 104, an outside surface of the sheet of flexible material 10 and an outside surface of the first leg 62, adjacent the floor 102. An outside surface of the first leg 62 is forced against one of the sheet of flexible material 10 and the sticky tape 58, while the second leg 64 is pushed against the sheet of flexible material 10 lying on the floor. The plurality of self-drilling fasteners 60 are threaded through the first leg 62 and into the base channel 104.

While particular embodiments of the invention have been shown and described, it will be obvious to those skilled in the art that changes, modifications and the order of steps may be made without departing from the invention in its broader aspects, and therefore, the aim in the appended claims is to cover all such changes and modifications as fall within the true spirit and scope of the invention.

I claim:

1. A method of pulling a sheet of flexible material across a building, the building including two inside corner struts, a plurality of support struts and a floor, comprising the steps of:

forming a plurality of lengthwise slits in a sheet of flexible material in a row, locating said sheet of flexible material adjacent a side wall of the building;

inserting a rod through said plurality of lengthwise slits;

providing at least one winch having a cable;

securing an end of said cable to said rod; and pulling said rod in the sheet of flexible material over an adjacent one of the two inside corner struts to one of an opposing side wall inside corner strut of the two inside corner struts and one of the plurality of support struts.

2. The method of pulling a sheet of flexible material across a building of claim 1, further comprising the step of:

attaching one of a base channel to the floor with a lag bolt and threaded nut; or attaching a lag bolt and threaded nut to the floor, adjacent the one side wall and the opposing side wall.

3. The method of pulling a sheet of flexible material across a building of claim 2, further comprising the step of:

providing each one of said at least one winch with a base plate, said base plate is retained by at least one lag bolt.

4. The method of pulling a sheet of flexible material across a building of claim 2, further comprising the step of:

providing at least one tensioning device having a first line, a ratchet device, a second line and a pull rod hook, one end of said first line is secured to one of said lag bolt and said base channel, the other end of said first line is secured to one end of said ratchet device, one end of said second line is secured to an opposing end of said ratchet device, an opposing end of said second line is secured to said pull rod hook, said pull rod hook is sized to receive said rod.

5. The method of pulling a sheet of flexible material across a building of claim 1, further comprising the step of:

attaching said sheet of flexible material to the inside corner strut with sticky tape, a metal angle and a plurality of fasteners, said sticky tape is applied to be in contact with an outside surface of said sheet of flexible material, said metal angle is applied to said sticky tape, said plurality of fasteners are drilled through said sheet of flexible material, said metal angle and said sticky tape into the inside corner strut.

6. The method of pulling a sheet of flexible material across a building of claim 5, further comprising the step of:

securing the sheet of flexible material to said base channel with said metal angle, said sticky tape and a plurality of fasteners, said sticky tape is applied on one of a surface of said sheet of flexible material adjacent the floor, and an exposed flange surface of said base channel, said sheet of flexible material is applied to said sticky tape, said metal angle is applied to one of said sheet of flexible material, and said sticky tape, said plurality of fasteners are installed through said metal angle and said sticky tape into said base channel.

7. A method of pulling a sheet of flexible material across a building, the building including two inside corner struts, a plurality of support struts and a floor, comprising the steps of:

forming a plurality of lengthwise slits in a sheet of flexible material in a row, locating said sheet of flexible material adjacent a side wall of the building;

inserting a rod through said plurality of lengthwise slits;

providing at least one winch having a cable;

providing at least one pull device secured to an end of said cable, said at least one pull device is secured to said rod; and pulling the sheet of material over the plurality of support struts to an opposing side wall.

8. The method of pulling a sheet of flexible material across a building of claim 7, further comprising the step of:

providing each one of said at least one pull device with a pull strap and a spreader bar, one end of said strap is removably secured to a first portion of said rod, the other end of said strap is removably secured to a second portion of said rod, each end of said spreader bar is secured to said pull strap.

9. The method of pulling a sheet of flexible material across a building of claim 7, further comprising the step of:

attaching one of a base channel to the floor with a lag bolt and threaded nut; or installing said lag bolt and threaded nut in the floor.

10. The method of pulling a sheet of flexible material across a building of claim 9, further comprising the step of:

providing each one of said at least one winch with a base plate, said base plate is retained by one of under said base channel, and by said lag bolt with threaded nut.

11. The method of pulling a sheet of flexible material across a building of claim 9, further comprising the step of:

providing at least one tensioning device having a first line, a ratchet device, a second line and a pull rod hook, one end of said first line is secured to one of said lag bolt and said base channel, the other end of said first line is secured to one end of said ratchet device, one end of said second line is secured to an opposing end of said ratchet device, an opposing end of said second line is secured to said pull rod hook, said pull rod hook is sized to receive said rod.

12. The method of pulling a sheet of flexible material across a building of claim 7, further comprising the step of:

attaching said sheet of flexible material to the inside corner strut with sticky tape, a metal angle and a plurality of fasteners, said sticky tape is applied to be in contact with an outside surface of said sheet of flexible material, said metal angle is applied to said sticky tape, said plurality of fasteners are drilled through said sheet of flexible material, said metal angle and said sticky tape into the inside corner strut.

13. The method of pulling a sheet of flexible material across a building of claim 12, further comprising the step of:

securing said sheet of flexible material to said base channel with said metal angle, said sticky tape and said plurality of fasteners, said sticky tape is applied on one of a surface of said sheet of flexible material adjacent the floor, and an exposed flange surface of said base channel, said sheet of flexible material is applied to the sticky tape, said metal angle is applied to one of said sheet of flexible material and said sticky tape, said plurality of fasteners are installed through said metal angle and said sticky tape into said base channel.

14. A method of pulling a sheet of flexible material across a building, the building including two inside corner struts, a plurality of support struts and a floor, comprising the steps of:

forming a plurality of lengthwise slits in a sheet of flexible material in a row, said plurality of slits extending across at least substantially all of a width of the sheet of flexible material, locating said sheet of flexible material adjacent a side wall of the building;

inserting a rod through said plurality of lengthwise slits;

providing at least one winch having a cable;

providing at least one pull device secured to an end of said cable, said at least one pull cable is secured to said rod;

pulling said rod in the sheet of flexible material over the plurality of support struts to an opposing side wall; and securing each end of said sheet of flexible material adjacent the floor.

15. The method of pulling a sheet of flexible material across a building of claim 14, further comprising the step of:

providing each one of said at least one pull device with a pull strap and a spreader bar, one end of said strap is removably secured to a first portion of said rod, the other end of said strap is removable secured to a second portion of said rod, each end of said spreader bar is secured to said pull strap.

16. The method of pulling a sheet of flexible material through a building of claim 14, further comprising the step of:

attaching one of a base channel to the floor with a lag bolt and threaded nut; or attaching a lag bolt with threaded nut to the floor, adjacent the one side wall and the opposing side wall.

17. The method of pulling a sheet of flexible material across a building of claim 16, further comprising the step of:

attaching one of a base channel to the floor with a lag bolt and threaded nut; and installing said lag bolt and threaded nut in the floor.

18. The method of pulling a sheet of flexible material across a building of claim 16, further comprising the step of:

providing at least one tensioning device having a first line, a ratchet device, a second line and a pull rod hook, one end of said first line is secured to one of said lag bolt and said base channel, the other end of said first line is secured to one end of said ratchet device, one end of said second line is secured to an opposing end of said ratchet device, an opposing end of said second line is secured to said pull rod hook, said pull rod hook is sized to receive said rod.

19. The method of pulling a sheet of flexible material across a building of claim 16, further comprising the step of:

securing said sheet of flexible material to one of said base channels with a metal angle, sticky tape and a plurality of fasteners, said sticky tape is applied on one of an exposed flange surface of said base channel, and an outside surface of said sheet of flexible material adjacent the floor, said metal angle is applied to one of said sticky tape, and said sheet of flexible material with said plurality of fasteners threaded through said metal angle and said sticky tape into said base channel.

20. The method of pulling a sheet of flexible material across a building of claim 14, further comprising the step of:

attaching said sheet of flexible material to the inside corner strut with sticky tape, a metal angle and a plurality of fasteners, said sticky tape is applied to be in contact with an outside surface of said sheet of flexible material, said metal angle is applied to said sticky tape, said plurality of fasteners are drilled through said sheet of flexible material, said metal angle and said sticky tape into the inside corner strut.

21. A method of pulling a sheet of flexible material across a building, the building including two inside corner struts, a plurality of support struts and a floor, comprising the steps of:

forming a plurality of lengthwise slits in a sheet of flexible material in a row, locating said sheet of flexible material adjacent a side wall of the building;

inserting a rod through said plurality of lengthwise slits;

providing at least one winch having a cable;

securing an end of said cable to said rod;

pulling said rod in the sheet of flexible material over an adjacent one of the two inside corner struts to one of an opposing side wall inside corner strut of the two inside corner struts and one of the plurality of support struts; and installing insulation in contact with said sheet of flexible material.

* * * * *